US009176457B2

(12) United States Patent
Yoshino et al.

(10) Patent No.: US 9,176,457 B2
(45) Date of Patent: Nov. 3, 2015

(54) IMAGE FORMING APPARATUS AND WASTE TONER CONVEYING DEVICE INCORPORATED IN SAME

(71) Applicants: Kaoru Yoshino, Tokyo (JP); Satoshi Hatori, Kanagawa (JP); Naohiro Kumagai, Kanagawa (JP); Akira Fujimori, Kanagawa (JP); Hideyasu Seki, Chiba (JP); Ryohta Gotoh, Tokyo (JP)

(72) Inventors: Kaoru Yoshino, Tokyo (JP); Satoshi Hatori, Kanagawa (JP); Naohiro Kumagai, Kanagawa (JP); Akira Fujimori, Kanagawa (JP); Hideyasu Seki, Chiba (JP); Ryohta Gotoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 24 days.

(21) Appl. No.: 13/920,571

(22) Filed: Jun. 18, 2013

(65) Prior Publication Data

US 2014/0010579 A1 Jan. 9, 2014

(30) Foreign Application Priority Data

Jul. 4, 2012 (JP) ..... 2012-150222

(51) Int. Cl.
*G03G 21/00* (2006.01)
*G03G 21/10* (2006.01)

(52) U.S. Cl.
CPC ..... *G03G 21/105* (2013.01)

(58) Field of Classification Search
CPC .... G03G 15/161; G03G 21/105; G03G 21/12
USPC ..... 399/358
See application file for complete search history.

(56) References Cited

U.S. PATENT DOCUMENTS

| | | | | |
|---|---|---|---|---|
| 2004/0052560 | A1* | 3/2004 | Ishii et al. | 399/360 |
| 2006/0039710 | A1 | 2/2006 | Tawada | |
| 2008/0013998 | A1 | 1/2008 | Kumagai et al. | |
| 2009/0060536 | A1 | 3/2009 | Kumagai | |
| 2009/0067856 | A1* | 3/2009 | Ito | 399/34 |
| 2009/0142115 | A1 | 6/2009 | Muraishi et al. | |

(Continued)

FOREIGN PATENT DOCUMENTS

| | | |
|---|---|---|
| CN | 1493932 A | 5/2004 |
| JP | 2006-085112 | 3/2006 |
| JP | 2007-219372 | 8/2007 |

OTHER PUBLICATIONS

Machine translation of Samejima JP 2007-219372 A, publication date: Aug. 30, 2007.*

(Continued)

*Primary Examiner* — Walter L Lindsay, Jr.
*Assistant Examiner* — Frederick Wenderoth
(74) *Attorney, Agent, or Firm* — Harness, Dickey & Pierce, P.L.C.

(57) ABSTRACT

An image forming apparatus includes a waste toner conveying device including a primary conveyor to convey waste toner discharged from a plurality of primary cleaners and a secondary conveyor to convey waste toner discharged from a secondary cleaner. A relay conveyor conveys the waste toner discharged from the primary conveyor and the secondary conveyor. A waste toner container receives the waste toner discharged from the relay conveyor. The primary conveyor, the secondary conveyor, and the relay conveyor are disposed at one end of the image forming apparatus in a front-to-rear direction thereof. A secondary conveyor outlet of the secondary conveyor is disposed below a primary conveyor outlet of the primary conveyor and above an inlet of the waste toner container.

18 Claims, 5 Drawing Sheets

(56) References Cited

U.S. PATENT DOCUMENTS

| | | | |
|---|---|---|---|
| 2009/0263147 | A1 | 10/2009 | Kumagai |
| 2010/0074665 | A1 | 3/2010 | Okamoto et al. |
| 2010/0080600 | A1 | 4/2010 | Okamoto et al. |
| 2011/0052225 | A1 | 3/2011 | Honjoh et al. |
| 2011/0097124 | A1 | 4/2011 | Koike et al. |
| 2012/0201573 | A1 * | 8/2012 | Watanabe et al. ..... 399/256 |

OTHER PUBLICATIONS

Office Action for corresponding Chinese application No. 201310245821.7 dated Jun. 30, 2015.

* cited by examiner

IMAGE FORMING APPARATUS AND WASTE TONER CONVEYING DEVICE INCORPORATED IN SAME

CROSS-REFERENCE TO RELATED APPLICATION

This patent application is based on and claims priority pursuant to 35 U.S.C. §119 to Japanese Patent Application No. 2012-150222, filed on Jul. 4, 2012, in the Japanese Patent Office, the entire disclosure of which is hereby incorporated by reference herein.

BACKGROUND

1. Field

Example embodiments generally relate to an image forming apparatus and a waste toner conveying device, and more particularly, to an image forming apparatus for forming a toner image and a waste toner conveying device for conveying waste toner that is installed in the image forming apparatus.

2. Discussion of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of each of a plurality of photoconductive drums; an optical writer emits a light beam onto the charged surface of the respective photoconductive drums to form an electrostatic latent image on the respective photoconductive drums according to the image data; a development device supplies toner to the electrostatic latent image formed on the respective photoconductive drums to render the electrostatic latent image visible as a toner image; the toner images formed on the photoconductive drums are primarily transferred onto an intermediate transfer belt to form a color toner image thereof; the color toner image is secondarily transferred onto a recording medium; finally, a fixing device applies heat and pressure to the recording medium bearing the color toner image to fix the color toner image on the recording medium, thus forming the color toner image on the recording medium.

Such image forming apparatuses may include the plurality of photoconductive drums aligned below the intermediate transfer belt. After the primary transfer of the toner images formed on the plurality of photoconductive drums onto the intermediate transfer belt, a plurality of primary cleaners removes residual toner failed to be transferred onto the intermediate transfer belt and therefore remaining on the photoconductive drums therefrom, respectively. The removed toner is discharged from the primary cleaners and collected into a waste toner container as waste toner. Additionally, after the secondary transfer of the color toner image formed on the intermediate transfer belt onto the recording medium, a secondary cleaner removes residual toner failed to be transferred onto the recording medium and therefore remaining on the intermediate transfer belt therefrom. The removed toner is discharged from the secondary cleaner and collected into the waste toner container as waste toner.

For example, the waste toner discharged from the primary cleaners is conveyed through a primary conveyor pipe in communication with a primary inlet of the waste toner container that is situated in proximity to the front of the image forming apparatus. Conversely, the waste toner discharged from the secondary cleaner is conveyed through a secondary conveyor pipe in communication with a secondary inlet of the waste toner container that is situated in proximity to the rear of the image forming apparatus. Thus, the waste toner removed from the plurality of photoconductive drums and the waste toner removed from the intermediate transfer belt are collected into the identical waste toner container through the separate conveyor pipes and inlets, respectively.

The primary conveyor pipe that conveys the waste toner discharged from the primary cleaners is situated in proximity to the front of the image forming apparatus to communicate with the primary inlet of the waste toner container that is also situated in proximity to the front of the image forming apparatus. Conversely, the secondary conveyor pipe that conveys the waste toner discharged from the secondary cleaner is situated in proximity to the rear of the image forming apparatus to communicate with the secondary inlet of the waste toner container that is also situated in proximity to the rear of the image forming apparatus.

Accordingly, the front, primary conveyor pipe and the rear, secondary conveyor pipe sandwich the photoconductive drums and the intermediate transfer belt in the front-to-rear direction of the image forming apparatus, upsizing the image forming apparatus in the front-to-rear direction thereof.

Additionally, since the waste toner container has the two inlets, that is, the primary inlet in communication with the primary conveyor pipe and the secondary inlet in communication with the secondary conveyor pipe, two shutters and seals are attached to the two inlets, respectively, increasing manufacturing costs of the waste toner container.

SUMMARY

At least one embodiment may provide an image forming apparatus that includes a plurality of image carriers to carry a toner image; an intermediate transferor, disposed opposite the plurality of image carriers, to receive the toner image transferred from each of the plurality of image carriers and to be transferred onto a recording medium; a plurality of primary cleaners, disposed opposite the plurality of image carriers, to remove waste toner failed to be transferred onto the intermediate transferor from the plurality of image carriers respectively; a secondary cleaner, disposed opposite the intermediate transferor, to remove waste toner failed to be transferred onto the recording medium from the intermediate transferor; and a waste toner conveying device connected to the plurality of primary cleaners and the secondary cleaner to convey the waste toner discharged from the plurality of primary cleaners and the secondary cleaner. The waste toner conveying device includes a primary conveyor, disposed below and connected to the plurality of primary cleaners, to convey the waste toner discharged from the plurality of primary cleaners. The primary conveyor includes a primary conveyor outlet through which the waste toner is discharged from the primary conveyor. A secondary conveyor, disposed below and connected to the secondary cleaner, to convey the waste toner discharged from the secondary cleaner, includes a secondary conveyor outlet through which the waste toner is discharged from the secondary conveyor. A relay conveyor, in communication with the primary conveyor outlet of the primary conveyor and the secondary conveyor outlet of the secondary conveyor, conveys the waste toner discharged from the primary conveyor and the secondary conveyor. A waste toner container includes an inlet in communication with the relay conveyor to receive the waste toner discharged from the relay conveyor. The primary conveyor, the secondary conveyor, and the relay conveyor are disposed at one end of the image forming apparatus in a front-to-rear direction thereof. The secondary conveyor outlet is disposed below the primary conveyor outlet and above the inlet of the waste toner container.

At least one embodiment may provide a waste toner conveying device for conveying waste toner conveyed from a plurality of primary cleaners and a secondary cleaner. The waste toner conveying device includes a primary conveyor, disposed below and connected to the plurality of primary cleaners, to convey the waste toner discharged from the plurality of primary cleaners. The primary conveyor includes a primary conveyor outlet through which the waste toner is discharged. A secondary conveyor, disposed below and connected to the secondary cleaner, conveys the waste toner discharged from the secondary cleaner. The secondary conveyor includes a secondary conveyor outlet through which the waste toner is discharged. A relay conveyor, in communication with the primary conveyor outlet of the primary conveyor and the secondary conveyor outlet of the secondary conveyor, conveys the waste toner discharged from the primary conveyor and the secondary conveyor. A waste toner container includes an inlet in communication with the relay conveyor to receive the waste toner discharged from the relay conveyor. The secondary conveyor outlet is disposed below the primary conveyor outlet and above the inlet of the waste toner container.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
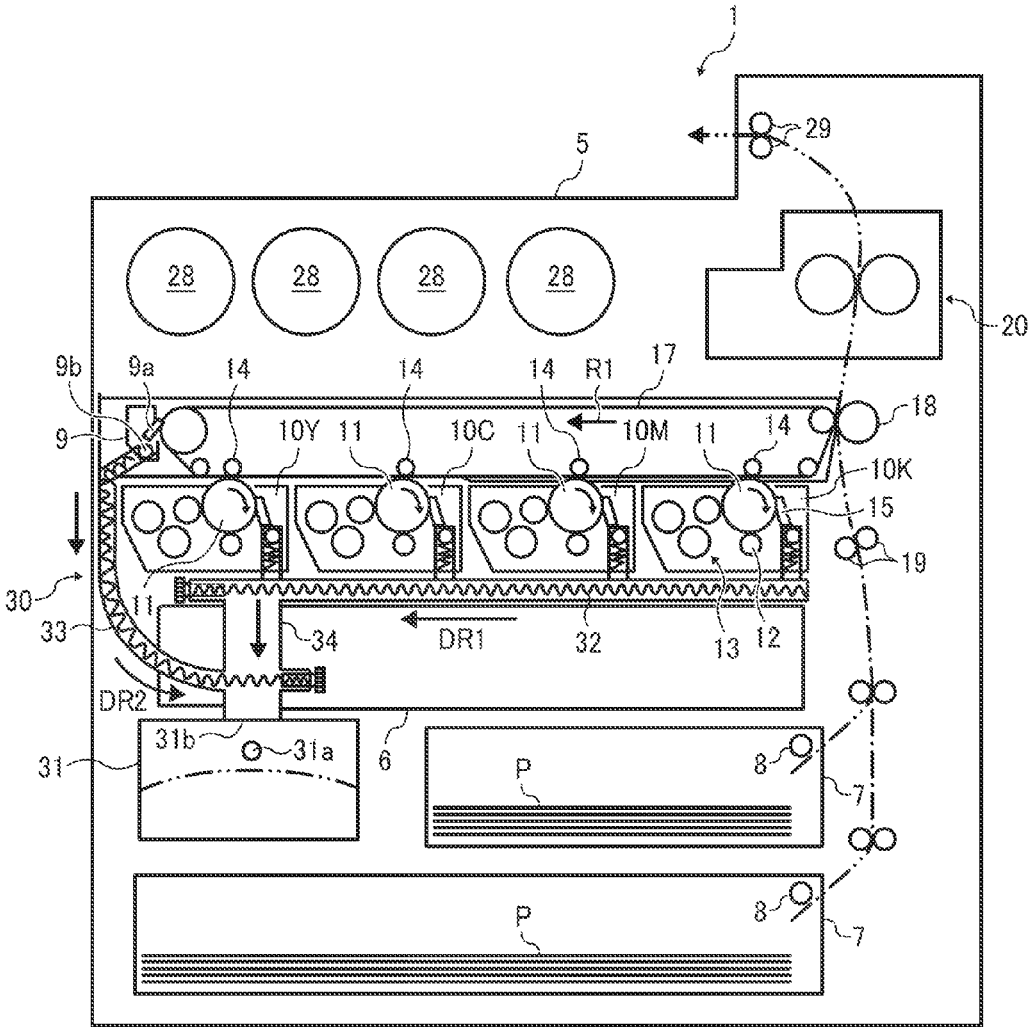
FIG. 1 is a schematic vertical sectional view of an image forming apparatus according to an example embodiment of the present invention.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic vertical sectional view of the image forming apparatus 1. The image forming apparatus 1 may be a copier, a facsimile machine, a printer, a multifunction printer (MFP) having at least one of copying, printing, scanning, plotter, and facsimile functions, or the like. According to this example embodiment, the image forming apparatus 1 is a tandem color printer that forms color and monochrome toner images on recording media by electrophotography.

As shown in FIG. 1, the image forming apparatus 1 includes an intermediate transfer belt 17 serving as an intermediate transferor and rotatable in a rotation direction R1. Below the intermediate transfer belt 17 is a plurality of process cartridges 10Y, 10C, 10M, and 10K disposed opposite the intermediate transfer belt 17 and aligned in the rotation direction R1 of the intermediate transfer belt 17.

Below the process cartridges 10Y, 10C, 10M, and 10K is a writer 6 (e.g., an exposure device) that emits laser beams onto the process cartridges 10Y, 10C, 10M, and 10K according to image data sent from an external device such as a client computer. Below the writer 6 is a plurality of paper trays 7 loading a plurality of recording media P (e.g., transfer sheets). The process cartridges 10Y, 10C, 10M, and 10K serve as image forming devices that form yellow, cyan, magenta, and black toner images, respectively. The intermediate transfer belt 17 serves as an intermediate transferor transferred with the yellow, cyan, magenta, and black toner images superimposed thereon to be formed into a color toner image. A secondary transfer roller 18, disposed opposite the intermediate transfer belt 17, secondarily transfers the color toner image formed on the intermediate transfer belt 17 onto a recording medium P sent from one of the paper trays 7. Above the secondary transfer roller 18 is a fixing device 20 that fixes the color toner image on the recording medium P. Above the intermediate transfer belt 17 is a plurality of toner containers 28 that contains yellow, cyan, magenta, and black toners to be supplied to development devices 13 of the process cartridges 10Y, 10C, 10M, and 10K, respectively. Below the writer 6 is a waste toner container 31. A waste toner conveying device 30 conveys waste toner collected from the process cartridges 10Y, 10C, 10M, and 10K and the intermediate transfer belt 17 to the waste toner container 31.

Each of the process cartridges 10Y, 10C, 10M, and 10K, that is, an image forming device, is formed in a unit that accommodates a photoconductive drum 11 serving as an image carrier, a charger 12, the development device 13, and a primary cleaner 15. Each of the process cartridges 10Y, 10C, 10M, and 10K is detachably attached to the image forming apparatus 1 such that it is replaceable with a new one when it is at the end of its useful life. For example, as a user opens a front cover 2 depicted in FIG. 5A of the image forming apparatus 1, the user pulls one of the process cartridges 10Y, 10C, 10M, and 10K that the user wishes to replace out of the image forming apparatus 1 in a rear-to-front direction of the image forming apparatus 1 that is orthogonal to the rotation direction R1 of the intermediate transfer belt 17. Thereafter, the user inserts a new process cartridge 10Y, 10C, 10M, or 10K into the image forming apparatus 1 in a front-to-rear direction counter to the rear-to-front direction and closes the front cover 2. Thus, replacement is completed.

The process cartridges 10Y, 10C, 10M, and 10K form yellow, cyan, magenta, and black toner images on the photoconductive drums 11 incorporated therein, respectively.

A description is provided of an image forming operation performed by the image forming apparatus 1 described above to form a color toner image.

As a controller (e.g., a processor), that is, a central processing unit (CPU) provided with a random-access memory (RAM) and a read-only memory (ROM), for example, of the image forming apparatus 1 receives color image data from an external device such as a client computer, the writer 6 emits laser beams onto the photoconductive drums 11 of the process cartridges 10Y, 10C, 10M, and 10K according to yellow, cyan, magenta, and black image data constituting the color image data, thus forming electrostatic latent images on the photoconductive drums 11.

Figure 2:
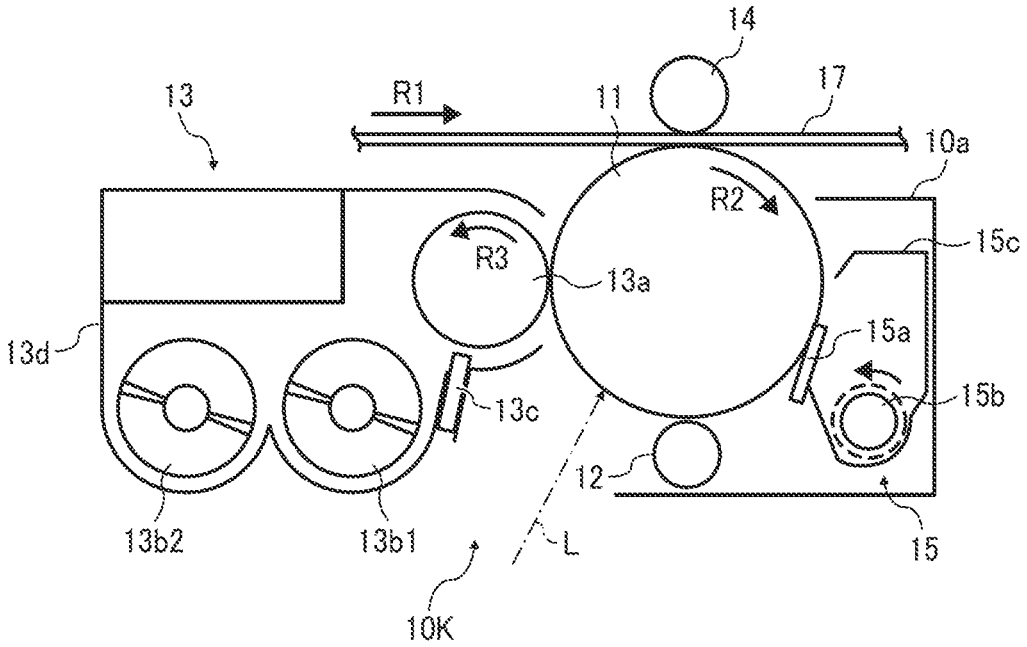
FIG. 2 is a vertical sectional view of a process cartridge installed in the image forming apparatus shown in FIG. 1.

With reference to FIG. 2, taking the process cartridge 10K that forms a black toner image, a detailed description is now given of formation of an electrostatic latent image on the photoconductive drum 11.

FIG. 2 is a vertical sectional view of the process cartridge 10K. As shown in FIG. 2, the photoconductive drum 11 rotates clockwise in FIG. 2 in a rotation direction R2.

In a charging process, the charger 12 (e.g., a charging roller) disposed opposite the photoconductive drum 11 uniformly charges an outer circumferential surface of the photoconductive drum 11. Thus, the photoconductive drum 11 bears a charging potential.

In an exposure process, as the charged outer circumferential surface of the photoconductive drum 11 reaches an irradiation position where the writer 6 depicted in FIG. 1 is disposed opposite the photoconductive drum 11, a light source of the writer 6 emits a laser beam L onto the charged outer circumferential surface of the photoconductive drum 11 according to an electric signal corresponding to the black image data. For example, laser beams L emitted from the light source to a polygon mirror are reflected by the polygon mirror toward a plurality of lenses. The laser beams L, after passing through the plurality of lenses, travel through different optical paths that lead to the photoconductive drums 11 of the process cartridges 10Y, 10C, 10M, and 10K, respectively.

As shown in FIG. 1, the writer 6 emits a laser beam L onto the leftmost photoconductive drum 11 in FIG. 1 of the process cartridge 10Y according to the yellow image data. For example, the polygon mirror rotating at high speed directs the laser beam L to scan the photoconductive drum 11 in a main scanning direction parallel to an axial direction of the photoconductive drum 11. Thus, an electrostatic latent image corresponding to the yellow image data is formed on the outer circumferential surface of the photoconductive drum 11 of the process cartridge 10Y that is charged by the charger 12.

Similarly, the writer 6 emits a laser beam L onto the second photoconductive drum 11 from the left in FIG. 1 of the process cartridge 10C according to the cyan image data, thus forming an electrostatic latent image corresponding to the cyan image data on the photoconductive drum 11. The writer 6 emits a laser beam L onto the third photoconductive drum 11 from the left in FIG. 1 of the process cartridge 10M according to the magenta image data, thus forming an electrostatic latent image corresponding to the magenta image data on the photoconductive drum 11. The writer 6 emits a laser beam L onto the rightmost photoconductive drum 11 in FIG. 1 of the process cartridge 10K, that is, the most downstream photoconductive drum 11 in the rotation direction R1 of the intermediate transfer belt 17, according to the black image data, thus forming an electrostatic latent image corresponding to the black image data on the photoconductive drum 11.

As shown in FIG. 2, in a development process, as the electrostatic latent image formed on the photoconductive drum 11 reaches a development position where the development device 13 is disposed opposite the photoconductive drum 11, the development device 13 supplies black toner to the electrostatic latent image formed on the photoconductive drum 11, thus developing the electrostatic latent image into a black toner image. Thereafter, the black toner image formed on the photoconductive drum 11 reaches a primary transfer position where a primary transfer roller 14 in contact with an inner circumferential surface of the intermediate transfer belt 17 is disposed opposite the photoconductive drum 11 via the intermediate transfer belt 17.

In a primary transfer process, the primary transfer roller 14 primarily transfers the black toner image formed on the photoconductive drum 11 onto an outer circumferential surface of the intermediate transfer belt 17. Similarly, as shown in FIG. 1, the development devices 13 of the process cartridges 10Y, 10C, and 10M develop the electrostatic latent images formed on the photoconductive drums 11 into yellow, cyan, and magenta toner images, respectively. Thus, as the intermediate transfer belt 17 rotates in the rotation direction R1, the yellow, cyan, magenta, and black toner images formed on the photoconductive drums 11 of the process cartridges 10Y, 10C, 10M, and 10K are primarily transferred onto a same position on the intermediate transfer belt 17 successively, thus forming a color toner image on the intermediate transfer belt 17.

As shown in FIG. 2, after the primary transfer process, the outer circumferential surface of the photoconductive drum 11 reaches a primary cleaning position where the primary cleaner 15 is disposed opposite the photoconductive drum 11. In a cleaning process, the primary cleaner 15, that is, an image carrier cleaner, removes residual toner failed to be transferred onto the intermediate transfer belt 17 and therefore remaining on the photoconductive drum 11 therefrom. The removed toner is collected into the primary cleaner 15.

Thereafter, as the outer circumferential surface of the photoconductive drum 11 passes through a discharging position where a discharger is disposed opposite the photoconductive drum 11, the discharger discharges the outer circumferential surface of the photoconductive drum 11. Thus, a series of image forming processes performed on the photoconductive drum 11 is completed.

On the other hand, as shown in FIG. 1, as the intermediate transfer belt 17 rotates in the rotation direction R1, the color toner image formed on the intermediate transfer belt 17 reaches a secondary transfer position where the secondary transfer roller 18 is disposed opposite the intermediate transfer belt 17. In a secondary transfer process, the secondary transfer roller 18 secondarily transfers the color toner image formed on the intermediate transfer belt 17 onto a recording medium P conveyed from one of the paper trays 7.

Thereafter, the outer circumferential surface of the intermediate transfer belt 17 from which the color toner image is secondarily transferred onto the recording medium P reaches a secondary cleaning position where a secondary cleaner 9, that is, an intermediate transferor cleaner, is disposed opposite the intermediate transfer belt 17. In a secondary cleaning process, the secondary cleaner 9 removes residual toner failed to be transferred onto the recording medium P and therefore remaining on the intermediate transfer belt 17 therefrom. The removed toner is collected into the secondary cleaner 9. Thus, a series of transfer processes, that is, the primary transfer process and the secondary transfer process, performed on the intermediate transfer belt 17 is completed.

The recording medium P is conveyed from one of the paper trays 7 through a conveyance guide and a registration roller pair 19 (e.g., a timing roller pair) to the secondary transfer roller 18. For example, the uppermost recording medium P of the plurality of recording media P loaded on one of the paper trays 7 is picked up and conveyed by a feed roller 8 through the conveyance guide to the registration roller pair 19. The registration roller pair 19 conveys the recording medium P to the secondary transfer roller 18 at a time when the color toner image formed on the intermediate transfer belt 17 reaches the secondary transfer roller 18.

Thereafter, the recording medium P receives the color toner image from the intermediate transfer belt 17 and is conveyed to the fixing device 20. In a fixing process, as the recording medium P bearing the color toner image passes through a fixing nip formed between a fixing roller and a pressing roller incorporated in the fixing device 20, the fixing roller and the pressing roller apply heat and pressure to the recording medium P, thus fixing the color toner image on the recording medium P. Thereafter, the recording medium P bearing the fixed color toner image is discharged by an output roller pair 29 onto an outside of the image forming apparatus 1, that is, an output tray 5 where the plurality of recording media P bearing the fixed color toner image is stacked. Thus, a series of image forming processes performed by the image forming apparatus 1 is completed.

With reference to FIG. 2, a description is provided of a construction of the process cartridge 10K.

FIG. 2 illustrates the process cartridge 10K that forms a black toner image. The process cartridges 10Y, 10C, 10M, and 10K form toner images in different colors, respectively. However, each of the other three process cartridges 10Y, 10C, and 10M has a construction equivalent to that of the process cartridge 10K. Hence, illustration and description of the construction of the process cartridges 10Y, 10C, and 10M are omitted.

As shown in FIG. 2, the process cartridge 10K includes the photoconductive drum 11 serving as an image carrier that carries an electrostatic latent image and a resultant toner image, the charger 12 that charges the outer circumferential surface of the photoconductive drum 11, the development device 13 that develops the electrostatic latent image formed on the photoconductive drum 11 into a black toner image, and the primary cleaner 15 that collects residual toner failed to be transferred onto the intermediate transfer belt 17 and therefore remaining on the photoconductive drum 11 therefrom. The photoconductive drum 11, the charger 12, the development device 13, and the primary cleaner 15 are housed in a case 10*a*.

A detailed description is now given of a construction of the photoconductive drum 11.

The photoconductive drum 11 is a negatively charged, organic photoconductor or photoreceptor. The photoconductive drum 11 includes a drum-shaped conductive support and a photosensitive layer mounted thereon. For example, the photoconductive drum 11 is constructed of a base layer serving as the conductive support; an insulating layer serving as an underlying layer; a charge generation layer or a charge transport layer serving as the photosensitive layer; and a protective layer serving as a surface layer, which are layered in this order.

A detailed description is now given of a construction of the charger 12.

The charger 12 is a charging roller constructed of a conductive metal core and an elastic layer coating an outer circumference of the metal core and having a medium resistance. As a power supply supplies a given voltage to the charger 12, the charger 12 uniformly charges the outer circumferential surface of the photoconductive drum 11 disposed opposite the charger 12.

A detailed description is now given of a construction of the development device 13.

The development device 13 is constructed of a development roller 13*a* disposed opposite the photoconductive drum 11; a primary conveyance screw 13*b*1 disposed opposite the development roller 13*a*; a secondary conveyance screw 13*b*2 disposed opposite the primary conveyance screw 13*b*1 via a partition; and a doctor blade 13*c* disposed opposite the development roller 13*a*. The development roller 13*a* is constructed of a magnet fixedly provided inside the development roller 13*a* to create a magnetic pole on a circumferential surface of the development roller 13*a* and a sleeve rotatable around the magnet. As the magnet creates a plurality of magnetic poles on the sleeve of the development roller 13*a*, the development roller 13*a* bears a developer, that is, a two-component developer containing carrier particles and toner particles accommodated in the development device 13.

A detailed description is now given of a construction of the primary cleaner 15 serving as an image carrier cleaner.

The primary cleaner 15 is constructed of a cleaning blade 15*a* in contact with the photoconductive drum 11 and a conveyance coil 15*b* disposed in proximity to the cleaning blade 15*a*. The cleaning blade 15*a* scrapes residual toner failed to be transferred onto the intermediate transfer belt 17 and therefore remaining on the photoconductive drum 11 off the photoconductive drum 11 into the primary cleaner 15. The conveyance coil 15*b* conveys the scraped toner collected into the primary cleaner 15 in a direction parallel to the axial direction of the photoconductive drum 11 to an outside of the primary cleaner 15 as waste toner. The cleaning blade 15*a* is made of rubber such as urethane rubber and in contact with the outer circumferential surface of the photoconductive drum 11 with a given angle and a given pressure. Thus, the cleaning blade 15*a* mechanically scrapes an adhesive substance adhered to the photoconductive drum 11 such as residual toner off the photoconductive drum 11 into the primary cleaner 15. The toner collected into the primary cleaner 15 is conveyed by the conveyance coil 15*b* to the outside of the primary cleaner 15 and further conveyed by the waste toner conveying device 30 depicted in FIG. 1 to the waste toner container 31. Thus, the toner is collected into the waste toner container 31 as waste toner. As shown in FIG. 2, the primary cleaner 15 is disposed opposite a right side of the photoconductive drum 11.

With reference to FIG. 1, a detailed description is now given of a construction of the secondary cleaner 9 serving as an intermediate transferor cleaner.

Similar to the primary cleaner 15, the secondary cleaner 9 is constructed of a cleaning blade 9*a* in contact with the intermediate transfer belt 17 and a conveyance coil 9*b* disposed in proximity to the cleaning blade 9*a*. The cleaning blade 9*a* scrapes residual toner failed to be transferred onto the recording medium P and therefore remaining on the intermediate transfer belt 17 off the intermediate transfer belt 17 into the secondary cleaner 9. The conveyance coil 9*b* conveys the scraped toner collected into the secondary cleaner 9 in a direction parallel to an axial direction of the intermediate transfer belt 17 to an outside of the secondary cleaner 9 as waste toner. The toner collected into the secondary cleaner 9 is conveyed by the conveyance coil 9*b* to the outside of the secondary cleaner 9 and further conveyed by the waste toner conveying device 30 to the waste toner container 31. Thus, the toner is collected into the waste toner container 31 as waste toner. As shown in FIG. 1, the secondary cleaner 9 is disposed opposite a left side of the intermediate transfer belt 17.

A detailed description of a configuration and an operation of the waste toner conveying device 30 is deferred.

Adhesive substances that may adhere to the photoconductive drum 11 and the intermediate transfer belt 17 may be residual toner failed to be transferred onto the intermediate transfer belt 17 and the recording medium P, paper dust produced from the recording medium P, a corona product produced on the photoconductive drum 11 as the charger 12 performs electric discharge, an additive added to toner, and the like. According to this example embodiment, those adhesive substances are defined as residual toner or waste toner.

With reference to FIG. 2, a detailed description is now given of the image forming processes described above.

The development roller 13*a* rotates counterclockwise in FIG. 2 in a rotation direction R3. As the primary conveyance screw 13*b*1 and the secondary conveyance screw 13*b*2 disposed opposite the primary conveyance screw 13*b*1 via the partition rotate, they circulate a developer accommodated inside a casing 13*d* of the development device 13 in a longitudinal direction of the primary conveyance screw 13*b*1 and the secondary conveyance screw 13*b*2 parallel to an axial direction thereof while the developer is agitated and mixed with fresh toner supplied from the toner container 28 depicted in FIG. 1 through a toner supply tube.

Toner particles attracted to carrier particles by frictional charging, together with the carrier particles, move onto the development roller 13*a*. As the development roller 13*a* rotates in the rotation direction R3, the developer, that is, the toner particles and the carrier particles, carried by the development roller 13*a* reaches the doctor blade 13*c*. After the doctor blade 13*c* adjusts an amount of the developer carried by the development roller 13*a*, the developer reaches the development position where the development roller 13*a* is disposed opposite the photoconductive drum 11.

At the development position, the toner particles contained in the developer adhere to the electrostatic latent image formed on the outer circumferential surface of the photoconductive drum 11. For example, an electrostatic latent image potential, that is, an exposure potential, created by a laser beam L irradiating the photoconductive drum 11 and a development bias applied to the development roller 13*a* produce a potential difference, that is, a development potential, that creates an electric field. The electric field causes the toner particles to adhere to the electrostatic latent image formed on the photoconductive drum 11, thus visualizing the electrostatic latent image into a toner image.

The toner, that is, the toner particles, adhered to the photoconductive drum 11 during the development process is mostly primarily transferred onto the intermediate transfer belt 17. Conversely, residual toner failed to be transferred onto the intermediate transfer belt 17 and therefore remaining on the photoconductive drum 11 is removed and collected by the cleaning blade 15*a* into a casing 15*c* of the primary cleaner 15.

The image forming apparatus 1 depicted in FIG. 1 accommodates a toner supply including the replaceable toner container 28 (e.g., a toner bottle) that contains fresh toner and a toner hopper that supports, drives, and rotates the toner container 28 to replenish the development device 13 with fresh toner from the toner container 28. The four toner containers 28 contain fresh yellow, cyan, magenta, and black toners, respectively. An inner circumferential surface of the toner container 28 mounts helical projections.

As the toner contained in the development device 13 is consumed, fresh toner contained in the toner container 28 is supplied into the development device 13 through a toner inlet. Consumption of the toner contained in the development device 13 is detected by a reflective photo sensor disposed opposite the photoconductive drum 11 or a magnetic sensor situated below the secondary conveyance screw 13*b*2 of the development device 13 directly or indirectly.

Optionally, a lubricant supplier for supplying a lubricant onto the outer circumferential surface of the photoconductive drum 11 may be located at a position downstream from the primary transfer roller 14 and upstream from the charger 12 in the rotation direction R2 of the photoconductive drum 11. For example, the lubricant may be made of zinc stearate and boron nitride. The lubricant decreases frictional resistance between the photoconductive drum 11 and the cleaning blade 15*a* sliding thereover, reducing frictional abrasion of the photoconductive drum 11 and the cleaning blade 15*a*.

With reference to FIGS. 1 to 4, a description is provided of a configuration and an operation of the waste toner conveying device 30.

Figure 3:
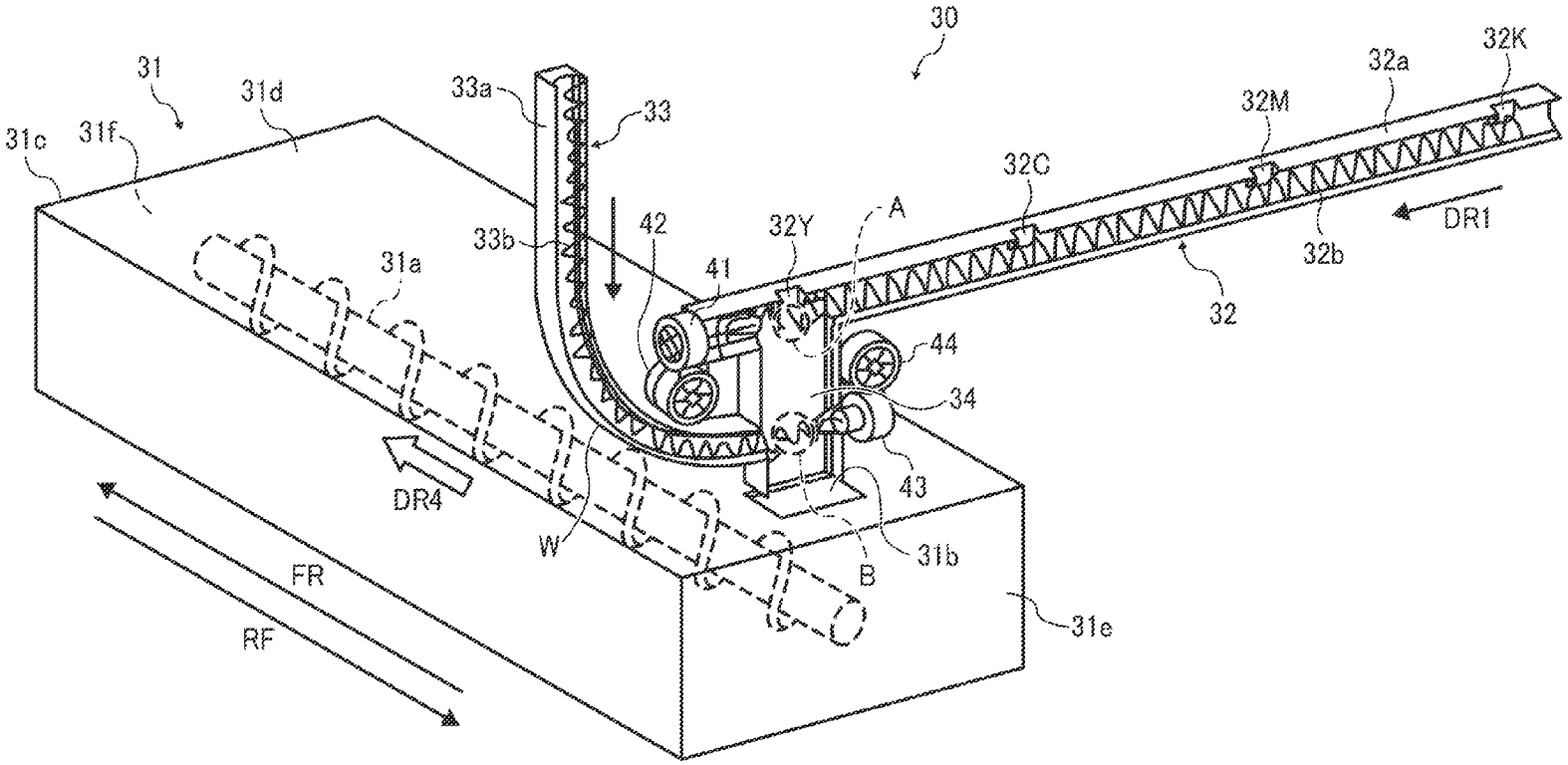
FIG. 3 is a perspective sectional view of a waste toner conveying device incorporated in the image forming apparatus shown in FIG. 1.
Figure 4:
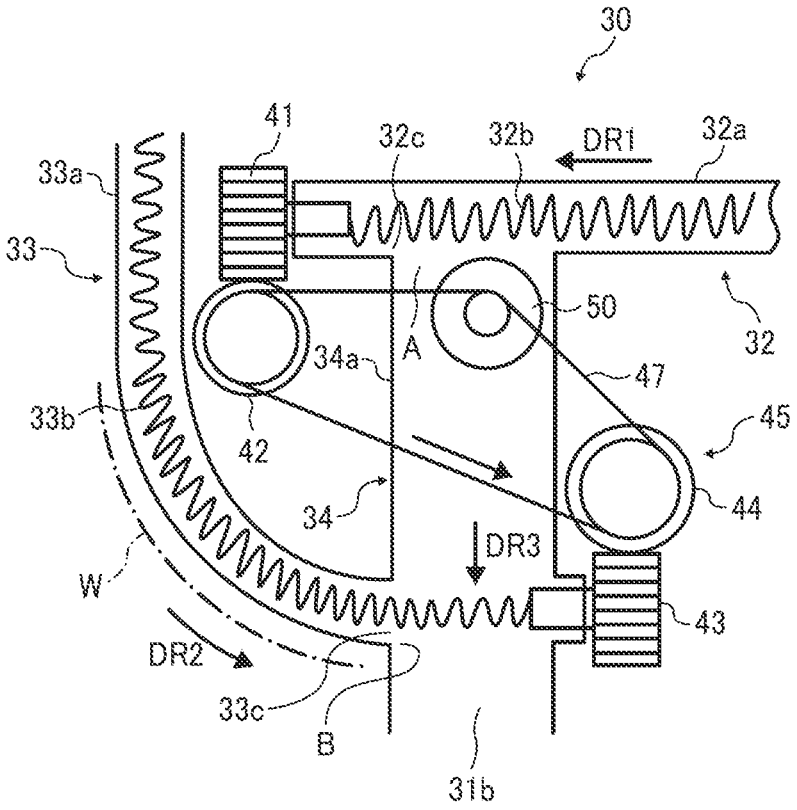
FIG. 4 is a partial vertical sectional view of the waste toner conveying device shown in FIG. 3.

FIG. 3 is a perspective sectional view of the waste toner conveying device 30. FIG. 4 is a partial vertical sectional view of the waste toner conveying device 30. As shown in FIG. 1, the waste toner conveying device 30 includes a primary conveyor 32 in communication with the primary cleaners 15 for the photoconductive drums 11 of the process cartridges 10Y, 10C, 10M, and 10K; a secondary conveyor 33 in communication with the secondary cleaner 9 for the intermediate transfer belt 17; a relay conveyor 34 in communication with the primary conveyor 32 and the secondary conveyor 33; and the waste toner container 31 in communication with the relay conveyor 34.

A detailed description is now given of a configuration of the primary conveyor 32.

The primary conveyor 32 is situated below the four primary cleaners 15 of the process cartridges 10Y, 10C, 10M, and 10K. The primary conveyor 32 conveys the waste toner discharged from the four primary cleaners 15 leftward in FIG. 1 in a waste toner conveyance direction DR1. For example, the primary conveyor 32 situated below the process cartridges 10Y, 10C, 10M, and 10K extends in the waste toner conveyance direction DR1 substantially parallel to the rotation direction R1 of the intermediate transfer belt 17. As shown in FIG. 3, the primary conveyor 32 includes a hollow, primary conveyor pipe 32*a* produced with four inlets 32Y, 32C, 32M, and 32K in an upper wall thereof and a primary conveyor coil 32*b* situated inside the primary conveyor pipe 32*a* and rotatable in a given direction. The primary conveyor coil 32*b* is manufactured by helically coiling a metal plate made of stainless steel or the like. For example, the metal plate may have a height of about 2 mm, a width of about 0.5 mm, and a thickness of about 0.4 mm. The primary conveyor coil 32*b* may be a helix having a pitch of about 10 mm and an outer loop diameter of about 12 mm. The primary conveyor coil 32*b* mounts a gear 41 at a leading end thereof in the waste toner conveyance direction DR1. As shown in FIG. 4, the gear 41 engages an idler gear 42 of a driving device 45 to receive a driving force from the driving device 45 that drives and rotates the primary conveyor coil 32*b* at about 200 rpm.

As shown in FIG. 2, black waste toner collected from the photoconductive drum 11 of the process cartridge 10K into the primary cleaner 15 is conveyed by the conveyance coil 15*b* substantially horizontally to a vertical conveyor. Thereafter, the black waste toner falls down through the vertical conveyor and enters the primary conveyor 32 through the inlet 32K depicted in FIG. 3. The black waste toner is conveyed through the primary conveyor pipe 32*a* by the primary conveyor coil 32*b* to a communication outlet A in communication with the relay conveyor 34.

Similarly, magenta waste toner collected from the photoconductive drum 11 of the process cartridge 10M into the primary cleaner 15 is conveyed by the conveyance coil 15*b* substantially horizontally to a vertical conveyor. Thereafter, the magenta waste toner falls down through the vertical conveyor and enters the primary conveyor 32 through the inlet 32M. The magenta waste toner is conveyed through the primary conveyor pipe 32*a* by the primary conveyor coil 32*b* to the communication outlet A in communication with the relay conveyor 34.

Cyan waste toner collected from the photoconductive drum 11 of the process cartridge 10C into the primary cleaner 15 is conveyed by the conveyance coil 15*b* substantially horizontally to a vertical conveyor. Thereafter, the cyan waste toner falls down through the vertical conveyor and enters the primary conveyor 32 through the inlet 32C. The cyan waste toner is conveyed through the primary conveyor pipe 32*a* by the primary conveyor coil 32*b* to the communication outlet A in communication with the relay conveyor 34.

Yellow waste toner collected from the photoconductive drum 11 of the process cartridge 10Y into the primary cleaner 15 is conveyed by the conveyance coil 15*b* substantially horizontally to a vertical conveyor. Thereafter, the yellow waste toner falls down through the vertical conveyor and enters the primary conveyor 32 through the inlet 32Y.

The yellow waste toner is conveyed through the primary conveyor pipe 32*a* by the primary conveyor coil 32*b* to the communication outlet A in communication with the relay conveyor 34 situated below the inlet 32Y. As shown in FIG. 4, the black, magenta, cyan, and yellow waste toners reaching the communication outlet A fall down in a waste toner conveyance direction DR3 through the relay conveyor 34 to an inlet 31*b* of the waste toner container 31 and are collected into the waste toner container 31.

A detailed description is now given of a configuration of the secondary conveyor 33.

As shown in FIG. 1, the secondary conveyor 33 is situated below the secondary cleaner 9 and on the left of the intermediate transfer belt 17 and the process cartridge 10Y. The secondary conveyor 33 conveys the waste toner discharged from the secondary cleaner 9 downward in FIG. 1 in a waste toner conveyance direction DR2. For example, the secondary conveyor 33 situated in proximity to one side, that is, the left side, of the image forming apparatus 1 extends substantially vertically such that the secondary conveyor 33 does not interfere with operation of the intermediate transfer belt 17 and the process cartridges 10Y, 10C, 10M, and 10K.

As shown in FIG. 4, the secondary conveyor 33 includes a curve W that joins the relay conveyor 34. For example, the secondary conveyor 33 includes a hollow, secondary conveyor pipe 33*a* produced with the curve W in a lower part thereof and a secondary conveyor coil 33*b* situated inside the secondary conveyor pipe 33*a* and rotatable in a given direction.

The secondary conveyor coil 33*b* is manufactured by helically coiling a metal plate made of stainless steel or the like. For example, the metal plate may have a height of about 2 mm, a width of about 0.5 mm, and a thickness of about 0.4 mm. The secondary conveyor coil 33*b* may be a helix having a pitch of about 8 mm and an outer loop diameter of about 12 mm. The secondary conveyor coil 33*b* mounts a gear 43 at a leading end thereof in the waste toner conveyance direction DR2. As shown in FIG. 4, the gear 43 engages an idler gear 44 of the driving device 45 to receive a driving force from the driving device 45 that drives and rotates the secondary conveyor coil 33*b* at about 200 rpm. For example, the curve W of the secondary conveyor 33 has a radius of curvature of about 60 mm.

The secondary conveyor coil 33*b* manufactured by helically coiling the metal plate, even if it is installed and used such that it is curved at the curve W thereof, is not broken readily. Additionally, the secondary conveyor coil 33*b* and the secondary conveyor pipe 33*a* are shaped to prevent breakage of the secondary conveyor coil 33*b* at the curve W and facilitate conveyance of the waste toner through the curve W of the secondary conveyor pipe 33*a* by the secondary conveyor coil 33*b*.

The waste toner collected from the intermediate transfer belt 17 depicted in FIG. 1 by the secondary cleaner 9 situated beside the intermediate transfer belt 17 is conveyed by a conveyance coil of the secondary cleaner 9 substantially horizontally in a toner conveyance direction orthogonal to the rotation direction R1 of the intermediate transfer belt 17 toward a front of the image forming apparatus 1. Thereafter, the waste toner is conveyed through a tilt conveyor and enters the secondary conveyor 33. As shown in FIG. 4, the waste toner in the secondary conveyor 33 is conveyed by the secondary conveyor coil 33*b* through the curve W of the secondary conveyor 33 to a communication outlet B in communication with the relay conveyor 34. The waste toner reaching the communication outlet B falls down through the relay conveyor 34 to the inlet 31*b* of the waste toner container 31 and is collected into the waste toner container 31.

A detailed description is now given of a configuration of the relay conveyor 34.

An area of an interior of the relay conveyor 34 where the waste toner is conveyed is greater than an area of an interior of the primary conveyor 32 and the secondary conveyor 33 where the waste toner is conveyed. That is, the relay conveyor 34 includes a hollow, relay conveyor pipe 34*a* having an inner diameter of the relay conveyor 34 that is greater than an inner diameter of the primary conveyor pipe 32*a* and the secondary conveyor pipe 33*a*. For example, the hollow, relay conveyor pipe 34*a* is a substantial prism extending vertically.

The relay conveyor 34 is in communication with a downstream, terminal end 32*c* of the primary conveyor 32 in the waste toner conveyance direction DR1 and a downstream, terminal end 33*c* of the secondary conveyor 33 in the waste toner conveyance direction DR2, that is, the communication outlet A of the primary conveyor 32 and the communication outlet B of the secondary conveyor 33. Thus, the relay conveyor 34 receives the waste toner discharged from the primary conveyor 32 through the communication outlet A and the waste toner discharged from the secondary conveyor 33 through the communication outlet B and guides the waste toner to the inlet 31*b* of the waste toner container 31.

The communication outlet B situated at the terminal end 33*c* of the secondary conveyor 33 and in communication with the relay conveyor 34 is above the inlet 31*b* of the waste toner container 31 and below the communication outlet A situated at the terminal end 32*c* of the primary conveyor 32 and in communication with the relay conveyor 34. That is, the communication outlet A of the primary conveyor 32, the communication outlet B of the secondary conveyor 33, and the inlet 31*b* of the waste toner container 31 are aligned in this order vertically. Accordingly, the waste toner discharged through the communication outlet A of the primary conveyor 32 and the waste toner discharged through the communication outlet B of the secondary conveyor 33 fall down through the relay conveyor 34 under their own weight into the waste toner container 31 through the single inlet 31*b*. For example, the inlet 31*b* is a substantial prism equivalent to that of the relay conveyor pipe 34*a* of the relay conveyor 34.

A description is provided of location of the primary conveyor 32, the secondary conveyor 33, and the relay conveyor 34.

As shown in FIGS. 1 and 3, the primary conveyor 32, the secondary conveyor 33, and the relay conveyor 34 are located inside the image forming apparatus 1 at one end in a front-to-rear direction FR of the image forming apparatus 1 that is orthogonal to the rotation direction R1 of the intermediate transfer belt 17, that is, a position in proximity to the front of the image forming apparatus 1. Accordingly, compared to a configuration in which the primary conveyor 32 is located at one end and the secondary conveyor 33 is located at another end in the front-to-rear direction FR of the image forming apparatus 1, the configuration in which the primary conveyor 32 and the secondary conveyor 33 are located at one end in the front-to-rear direction FR of the image forming apparatus 1 downsizes the image forming apparatus 1 in the front-to-rear direction FR thereof.

Since the communication outlet B of the secondary conveyor 33 is situated below the communication outlet A of the primary conveyor 32, the secondary conveyor 33 extends over a given vertical span spanning from a side on the left of the intermediate transfer belt 17 situated above the four process cartridges 10Y, 10C, 10M, and 10K to a position in proximity to the inlet 31*b* of the waste toner container 31. Accordingly, compared to a configuration in which the communication outlet B of the secondary conveyor 33 is situated above or at a position vertically equivalent to that of the communication outlet A of the primary conveyor 32 while the height of the image forming apparatus 1 is identical, the configuration in which the secondary conveyor 33 extends over the given vertical span, even if it has the curve W, has a relatively small curvature. Consequently, a substantial load in a shear direction is not imposed on the secondary conveyor coil 33*b* curved at the curve W, preventing breakage of the secondary conveyor coil 33*b* and facilitating conveyance of the waste toner through the curve W of the secondary conveyor coil 33*b*.

Additionally, the curve W of the secondary conveyor 33 downsizes the image forming apparatus 1 horizontally as well as vertically. Since the waste toner discharged from the primary conveyor 32 and the waste toner discharged from the secondary conveyor 33 are collected into the waste toner container 31 through the single inlet 31*b*, the waste toner container 31 is downsized at reduced manufacturing costs.

As shown in FIG. 3, the primary conveyor 32, the secondary conveyor 33, and the relay conveyor 34 are located at one end of the image forming apparatus 1 in the front-to-rear direction FR thereof, that is, at a position in proximity to the front of the image forming apparatus 1 through which the four process cartridges 10Y, 10C, 10M, and 10K are attached to and detached from the image forming apparatus 1. As shown in FIG. 1, seeing from the front of the image forming apparatus 1, that is, in cross-section orthogonal to the front-to-rear direction FR in which the process cartridges 10Y, 10C, 10M, and 10K are attached to the image forming apparatus 1, the primary conveyor 32, the secondary conveyor 33, and the relay conveyor 34 do not overlap the process cartridges 10Y, 10C, 10M, and 10K.

Accordingly, the process cartridges 10Y, 10C, 10M, and 10K are attached to the image forming apparatus 1 in the front-to-rear direction FR thereof and detached from the image forming apparatus 1 in a rear-to-front direction RF thereof smoothly without interference with the waste toner conveying device 30.

A driver (e.g., a motor) for driving and rotating rotatable components (e.g., the photoconductive drums 11, the fixing roller of the fixing device 20, the development roller 13*a*, the registration roller pair 19, and the feed rollers 8) is situated in proximity to a rear of the image forming apparatus 1. Accordingly, as the driver is energized, the driver heats atmosphere in proximity to the driver, increasing the temperature of atmosphere in proximity to the rear of the image forming apparatus 1 relative the temperature of atmosphere in proximity to the front of the image forming apparatus 1.

To address this circumstance, according to this example embodiment, the primary conveyor 32, the secondary conveyor 33, and the relay conveyor 34 are located in proximity to the front of the image forming apparatus 1, preventing degradation of fluidity of the waste toner conveyed through the primary conveyor 32, the secondary conveyor 33, and the relay conveyor 34 that may arise due to an increased temperature of atmosphere surrounding the primary conveyor 32, the secondary conveyor 33, and the relay conveyor 34.

As shown in FIG. 4, an identical driver, that is, a motor 50, drives and rotates the primary conveyor coil 32*b* of the primary conveyor 32 and the secondary conveyor coil 33*b* of the secondary conveyor 33. For example, as shown in FIG. 4, the gear 41 mounted on the leading end of the primary conveyor coil 32*b* of the primary conveyor 32 engages the idler gear 42. The idler gear 42 is constructed of a shaft extending orthogonal to a shaft of the gear 41; a screw gear mounted on the shaft;

and a timing pulley engaging a timing belt 47. The screw gear and the timing pulley are arranged in two steps in an axial direction of the shaft of the idler gear 42. The gear 43 mounted on the leading end of the secondary conveyor coil 33*b* of the secondary conveyor 33 engages the idler gear 44.

Similar to the idler gear 42, the idler gear 44 is constructed of a shaft extending orthogonal to a shaft of the gear 43; a screw gear mounted on the shaft; and a timing pulley engaging the timing belt 47. The screw gear and the timing pulley are arranged in two steps in an axial direction of the shaft of the idler gear 44.

The timing belt 47 is stretched across and supported by the timing pulleys of the two idler gears 42 and 44 and a timing pulley mounted on a motor shaft of the motor 50. A driving force generated by the motor 50 is transmitted to the two idler gears 42 and 44 via the timing belt 47, thus driving and rotating the primary conveyor coil 32*b* of the primary conveyor 32 and the secondary conveyor coil 33*b* of the secondary conveyor 33 simultaneously. Thus, the single motor 50 drives and rotates the two coils, that is, the primary conveyor coil 32*b* and the secondary conveyor coil 33*b*, downsizing the waste toner conveying device 30 at reduced manufacturing costs compared to a configuration in which separate motors drive and rotate the primary conveyor coil 32*b* and the secondary conveyor coil 33*b*, respectively.

As shown in FIG. 4, the primary conveyor pipe 32*a* of the primary conveyor 32, the secondary conveyor pipe 33*a* of the secondary conveyor 33, and the relay conveyor pipe 34*a* of the relay conveyor 34 are molded into a unit by blow or injection molding. Accordingly, the primary conveyor pipe 32*a* of the primary conveyor 32, the secondary conveyor pipe 33*a* of the secondary conveyor 33, and the relay conveyor pipe 34*a* of the relay conveyor 34 molded into a unit reduce the number of components constituting the waste toner conveying device 30 and manufacturing costs of the waste toner conveying device 30 compared to a configuration in which the primary conveyor pipe 32*a*, the secondary conveyor pipe 33*a*, and the relay conveyor pipe 34*a* are separate components, respectively.

A description is provided of a configuration of the waste toner container 31.

The waste toner container 31 is detachably attached to the image forming apparatus 1. As the waste toner container 31 is full of the waste toner, the waste toner container 31 is replaced with a new vacant one. For example, as the user opens the front cover 2 depicted in FIG. 5A of the image forming apparatus 1, the user removes the waste toner container 31 out of the image forming apparatus 1 in the rear-to-front direction RF of the image forming apparatus 1 and then inserts the new waste toner container 31 into the image forming apparatus 1 in the front-to-rear direction FR.

Figure 5A:
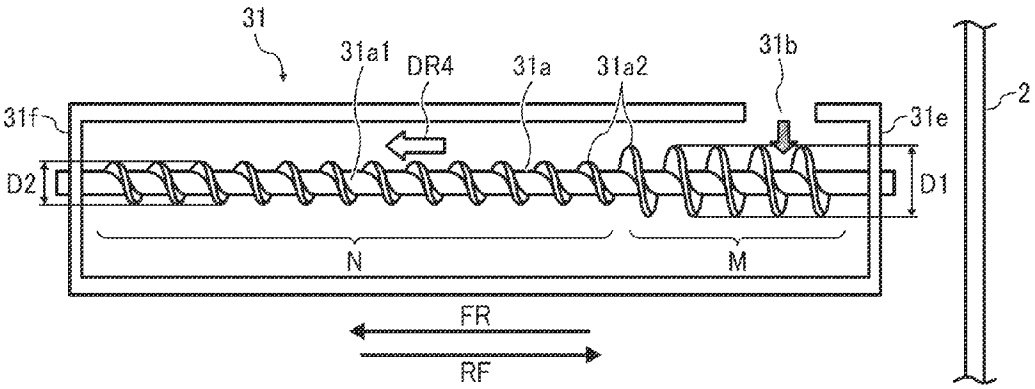
FIG. 5A is a vertical sectional view of a waste toner container incorporated in the waste toner conveying device shown in FIG. 4.

FIG. 5A is a vertical sectional view of the waste toner container 31. As shown in FIG. 5A, the waste toner container 31 is a substantial rectangle extending in a longitudinal direction thereof parallel to the front-to-rear direction FR of the image forming apparatus 1.

As shown in FIG. 3, the inlet 31*b* of the waste toner container 31 is produced through an upper face 31*d* of a casing 31*c* of the waste toner container 31 and situated in proximity to the front cover 2 of the image forming apparatus 1. A shutter attached to the inlet 31*b* of the waste toner container 31 is interlocked with movement of the waste toner container 31. As the waste toner container 31 is attached to the image forming apparatus 1, the shutter opens to allow the waste toner to enter the waste toner container 31 through the inlet 31*b*. Conversely, as the waste toner container 31 is detached from the image forming apparatus 1, the shutter closes to prohibit the waste toner from entering the waste toner container 31 through the inlet 31*b*.

As shown in FIG. 3, the waste toner container 31 includes a front face 31*e* of the casing 31*c* that faces the front cover 2 depicted in FIG. 5A of the image forming apparatus 1 and a rear face 31*f* of the casing 31*c* that faces the rear of the image forming apparatus 1. The waste toner container 31 accommodates a screw 31*a* serving as a conveying member that conveys the waste toner received from the inlet 31*b* situated in proximity to the front face 31*e* toward the rear face 31*f* in the front-to-rear direction FR of the image forming apparatus 1 that is orthogonal to the waste toner conveyance direction DR3 in which the waste toner is conveyed through the relay conveyor 34. As shown in FIG. 5A, the screw 31*a* is situated in an upper portion of the waste toner container 31 and extends in the front-to-rear direction FR. For example, the screw 31*a* is constructed of a shaft 31*a*1 having an outer diameter of about 6 mm and threads 31*a*2 mounted on the shaft 31*a*1 and having an outer diameter of about 12 mm. The pitch between the threads 31*a*2 is about 8 mm. As the screw 31*a* receives a driving force from a motor, the screw 31*a* is driven and rotated at about 60 rpm, conveying the waste toner in a waste toner conveyance direction DR4. Accordingly, even if the inlet 31*b* is situated in proximity to the front face 31*e* of the waste toner container 31, the waste toner is not accumulated in proximity to the front face 31*e* but is dispersed and accumulated evenly throughout the longitudinal direction of the waste toner container 31.

As shown in FIG. 5A, a conveyance capacity of the screw 31*a* for conveying the waste toner in a front conveyance span M in an axial direction of the screw 31*a* is greater than a conveyance capacity of the screw 31*a* for conveying the waste toner in a rear conveyance span N contiguous to the front conveyance span M in the axial direction of the screw 31*a*. For example, a first diameter D1 of the threads 31*a*2 corresponding to the front conveyance span M is greater than a second diameter D2 of the threads 31*a*2 corresponding to the rear conveyance span N.

Figure 5B:
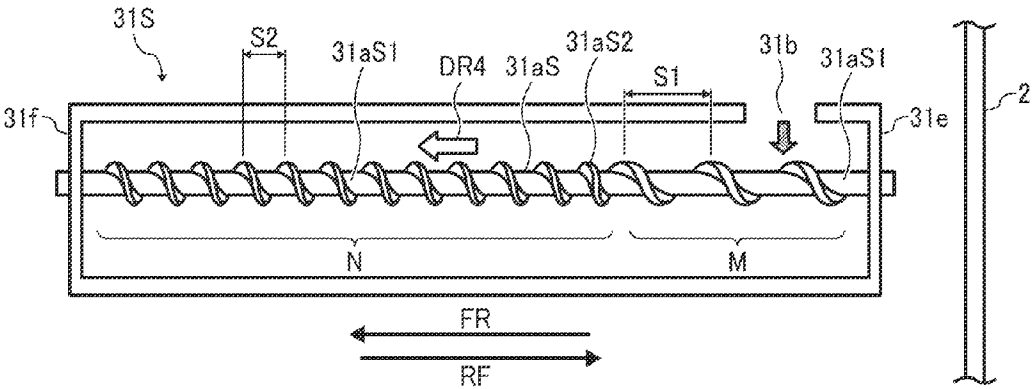
FIG. 5B is a vertical sectional view of another waste toner container as a variation of the waste toner container shown in FIG. 5A.

FIG. 5B is a vertical sectional view of a waste toner container 31S incorporating a screw 31*a*S as a variation of the screw 31*a* depicted in FIG. 5A. As shown in FIG. 5B, the screw 31*a*S includes a shaft 31*a*S1 and threads 31*a*S2 mounted on the shaft 31*a*S1. A first pitch S1 of the threads 31*a*S2 corresponding to the front conveyance span M is greater than a second pitch S2 of the threads 31*a*S2 corresponding to the rear conveyance span N.

As shown in FIGS. 5A and 5B, over the front conveyance span M in proximity to the inlet 31*b*, the threads 31*a*2 of the screw 31*a* have the greater diameter D1 and the threads 31*a*S2 of the screw 31*a*S have the greater pitch S1. Thus, as the waste toner enters the waste toner container 31 or 31S through the inlet 31*b*, the waste toner is conveyed in the front-to-rear direction FR toward the rear face 31*f* of the waste toner container 31 or 31S quickly. Accordingly, after a relatively large solid toner image is formed on both sides of a recording medium P, even if a substantial amount of waste toner is conveyed from the primary conveyor 32, the secondary conveyor 33, and the relay conveyor 34 into the waste toner container 31 or 31S through the inlet 31*b* collectively, the waste toner is not accumulated below the inlet 31*b* and does not overflow the waste toner container 31 or 31S through the inlet 31*b*. That is, the waste toner inside the waste toner container 31 or 31S is leveled by the screw 31*a* or 31*a*S. Consequently, the waste toner is collected into the waste toner container 31 or 31S effectively.

As shown in FIG. 4, the relay conveyor 34 is in communication with the terminal end 32*c* of the primary conveyor 32 that receives waste toner removed from the photoconductive drums 11 of the process cartridges 10Y, 10C, 10M, and 10K and the terminal end 33*c* of the secondary conveyor 33 that receives waste toner removed from the intermediate transfer belt 17. The relay conveyor 34 is in communication with the inlet 31*b* of the waste toner container 31 or 31S. The secondary conveyor 33 has the curve W. The communication outlet B of the secondary conveyor 33, in communication with the relay conveyor 34, situated at the terminal end 33*c* of the secondary conveyor 33 is above the inlet 31*b* of the waste toner container 31 or 31S and below the communication outlet A of the primary conveyor 32, in communication with the relay conveyor 34, situated at the terminal end 32*c* of the primary conveyor 32. Accordingly, the waste toner is conveyed and collected into the waste toner container 31 or 31S effectively with the waste toner conveying device 30 downsized at reduced manufacturing costs, which also downsizes the image forming apparatus 1.

As shown in FIG. 1, the components constituting the image forming device, that is, the photoconductive drum 11, the charger 12, the development device 13, and the primary cleaner 15, are integrated into a unit, that is, each of the process cartridges 10Y, 10C, 10M, and 10K, resulting in the compact image forming device and improved maintenance.

Alternatively, one or more of the photoconductive drum 11, the charger 12, the development device 13, and the primary cleaner 15 may not constitute a process cartridge and therefore may be removable from the image forming apparatus 1 for replacement separately from other components. In this case also, the advantages of the waste toner conveying device 30 described above are achieved.

According to the above-described example embodiments, the image forming apparatus 1 installed with the waste toner conveying device 30 incorporates the development device 13 that employs a two-component development method using a two-component developer containing toner particles and carrier particles. Alternatively, the image forming apparatus 1 may incorporate a development device that employs a one-component development method using a one-component developer containing toner particles.

It is to be noted that a process cartridge defines a unit detachably attached to the image forming apparatus 1 and constructed of an image carrier (e.g., the photoconductive drum 11) and at least one of a charger (e.g., the charger 12) that charges the image carrier, a development device (e.g., the development device 13) that develops an electrostatic latent image formed on the image carrier into a visible image, and a cleaner (e.g., the primary cleaner 15) that cleans the image carrier.

A description is provided of advantages of the waste toner conveying device 30.

As shown in FIG. 1, the waste toner conveying device 30 conveys waste toner to the waste toner container 31. The waste toner conveying device 30 includes the primary conveyor 32, the secondary conveyor 33, the relay conveyor 34, and the waste toner container 31. The plurality of primary cleaners 15 removes residual toner failed to be transferred onto the intermediate transferor (e.g., the intermediate transfer belt 17) and therefore remaining on the plurality of image carriers (e.g., the photoconductive drums 11) from the plurality of image carriers, respectively. The primary conveyor 32, disposed below the plurality of primary cleaners 15, conveys the residual toner discharged from the plurality of primary cleaners 15 to the relay conveyor 34 as waste toner. The secondary cleaner 9 removes residual toner failed to be transferred onto a recording medium P and therefore remaining on the intermediate transferor therefrom. The plurality of image carriers is disposed opposite the intermediate transferor and aligned along the intermediate transferor. The secondary conveyor 33, disposed below the secondary cleaner 9, conveys the residual toner discharged from the secondary cleaner 9 to the relay conveyor 34 as waste toner.

As shown in FIG. 4, the relay conveyor 34 communicates with the terminal end 32*c* of the primary conveyor 32 and the terminal end 33*c* of the secondary conveyor 33, thus conveying the waste toner discharged from the primary conveyor 32 and the secondary conveyor 33 to the inlet 31*b* of the waste toner container 31. The primary conveyor 32, the secondary conveyor 33, and the relay conveyor 34 are located at one end of the image forming apparatus 1 in the front-to-rear direction FR thereof. The secondary conveyor 33 includes the curve W. The communication outlet B of the secondary conveyor 33 disposed at the terminal end 33*c* of the secondary conveyor 33 and in communication with the relay conveyor 34 is situated above the inlet 31*b* of the waste toner container 31 and below the communication outlet A of the primary conveyor 32 disposed at the terminal end 32*c* of the primary conveyor 32 and in communication with the relay conveyor 34.

The relay conveyor 34 in communication with the primary conveyor outlet A of the primary conveyor 32 and the secondary conveyor outlet B of the secondary conveyor 33 communicates with the inlet 31*b* of the waste toner container 31. The secondary conveyor 33 has the curve W. The secondary conveyor outlet B of the secondary conveyor 33 is above the inlet 31*b* of the waste toner container 31 and below the primary conveyor outlet A of the primary conveyor 32. Accordingly, the waste toner conveying device 30 downsized at reduced manufacturing costs conveys the waste toner to the waste toner container 31 that collects the waste toner precisely. Further, the image forming apparatus 1 installed with the downsized waste toner conveying device 30 is also downsized at reduced manufacturing costs.

As shown in FIG. 1, according to the example embodiments described above, the plurality of process cartridges 10Y, 10C, 10M, and 10K is situated below the intermediate transfer belt 17. Alternatively, the plurality of process cartridges 10Y, 10C, 10M, and 10K may be situated above the intermediate transfer belt 17. In this case, the primary conveyor pipe 32*a* of the primary conveyor 32 that is connected to the primary cleaners 15 may be curved. Conversely, the secondary conveyor pipe 33*a* of the secondary conveyor 33 that is connected to the secondary cleaner 9 may be straight.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. An image forming apparatus comprising:

a plurality of image carriers to carry a toner image;

an intermediate transferor, disposed opposite the plurality of image carriers, to receive the toner image transferred from each of the plurality of image carriers and to be transferred onto a recording medium;

a plurality of primary cleaners, disposed opposite the plurality of image carriers, to remove waste toner failed to be transferred onto the intermediate transferor from the plurality of image carriers, respectively;

a secondary cleaner, disposed opposite the intermediate transferor, to remove waste toner failed to be transferred onto the recording medium from the intermediate transferor; and a waste toner conveying device connected to the plurality of primary cleaners and the secondary cleaner to convey the waste toner discharged from the plurality of primary cleaners and the secondary cleaner, the waste toner conveying device including:

a primary conveyor, disposed below and connected to the plurality of primary cleaners, to convey the waste toner discharged from the plurality of primary cleaners, the primary conveyor including a primary conveyor outlet through which the waste toner is discharged from the primary conveyor, the primary conveyor includes a hollow, primary conveyor pipe and a rotatable, primary conveyor coil, disposed inside the primary conveyor pipe, to convey the waste toner to the primary conveyor outlet;

a secondary conveyor, disposed below and connected to the secondary cleaner, to convey the waste toner discharged from the secondary cleaner, the secondary conveyor including a secondary conveyor outlet through which the waste toner is discharged from the secondary conveyor, the secondary conveyor includes a hollow curved secondary conveyor pipe and a rotatable, secondary conveyor coil, disposed inside the secondary conveyor pipe, to convey the waste toner to the secondary conveyor outlet;

a relay conveyor, in communication with the primary conveyor outlet of the primary conveyor and the secondary conveyor outlet of the secondary conveyor, to convey the waste toner discharged from the primary conveyor and the secondary conveyor, the relay conveyor includes a hollow, relay conveyor pipe of which an area of an interior of the relay conveyor is greater than an area of an interior of the primary conveyor pipe and the secondary conveyor pipe; and a waste toner container including an inlet in communication with the relay conveyor to receive the waste toner discharged from the relay conveyor, wherein the primary conveyor, the secondary conveyor, and the relay conveyor are disposed at one end of the image forming apparatus in a front-to-rear direction thereof, and wherein the secondary conveyor outlet is disposed below the primary conveyor outlet and above the inlet of the waste toner container.

2. The image forming apparatus according to claim 1, further comprising a plurality of process cartridges accommodating the plurality of image carriers, respectively, and attachable to the image forming apparatus in the front-to-rear direction and detachable from the image forming apparatus in a rear-to-front direction thereof, wherein the one end of the image forming apparatus in the front-to-rear direction thereof where the primary conveyor, the secondary conveyor, and the relay conveyor are disposed is in proximity to a front of the image forming apparatus, and wherein the primary conveyor, the secondary conveyor, and the relay conveyor do not overlap the plurality of process cartridges in a direction orthogonal to the front-to-rear direction of the image forming apparatus.

3. The image forming apparatus according to claim 1, wherein the rotatable, secondary conveyor coil, is made of a helically coiled metal plate.

4. The image forming apparatus according to claim 1, wherein the primary conveyor pipe includes a downstream, terminal end in a waste toner conveyance direction that is produced with the primary conveyor outlet and the secondary conveyor pipe includes a downstream, terminal end in a waste toner conveyance direction that is produced with the secondary conveyor outlet.

5. The image forming apparatus according to claim 1, further comprising a driver connected to the primary conveyor coil of the primary conveyor and the secondary conveyor coil of the secondary conveyor to drive and rotate the primary conveyor coil and the secondary conveyor coil.

6. The image forming apparatus according to claim 1, wherein the relay conveyor extends substantially vertically and joins the primary conveyor pipe of the primary conveyor and the secondary conveyor pipe of the secondary conveyor.

7. The image forming apparatus according to claim 1, wherein the waste toner container further includes a conveying member extending in the front-to-rear direction of the image forming apparatus to convey the waste toner received through the inlet.

8. The image forming apparatus according to claim 7, wherein the conveying member includes a screw including:

a shaft; and threads mounted on the shaft, and wherein the screw has a front conveyance span spanning in an axial direction of the screw and a rear conveyance span contiguous to the front conveyance span and spanning in the axial direction of the screw.

9. The image forming apparatus according to claim 8, wherein the threads have a first diameter corresponding to the front conveyance span and a second diameter corresponding to the rear conveyance span and smaller than the first diameter of the threads.

10. The image forming apparatus according to claim 8, wherein the threads have a first pitch corresponding to the front conveyance span and a second pitch corresponding to the rear conveyance span and smaller than the first pitch of the threads.

11. The image forming apparatus according to claim 1, wherein the plurality of image carriers is disposed below the intermediate transferor.

12. A waste toner conveying device for conveying waste toner conveyed from a plurality of primary cleaners and a secondary cleaner, the waste toner conveying device comprising:

a primary conveyor, disposed below and connected to the plurality of primary cleaners, to convey the waste toner discharged from the plurality of primary cleaners, the primary conveyor including a primary conveyor outlet through which the waste toner is discharged from the primary conveyor, the primary conveyor includes a hollow, primary conveyor pipe and a rotatable, primary conveyor coil, disposed inside the primary conveyor pipe, to convey the waste toner to the primary conveyor outlet;

a secondary conveyor, disposed below and connected to the secondary cleaner, to convey the waste toner discharged from the secondary cleaner, the secondary conveyor including a secondary conveyor outlet through which the waste toner is discharged from the secondary conveyor, the secondary conveyor includes a hollow curved secondary conveyor pipe and a rotatable, secondary conveyor coil, disposed inside the secondary conveyor pipe, to convey the waste toner to the secondary conveyor outlet;

a relay conveyor, in communication with the primary conveyor outlet of the primary conveyor and the secondary conveyor outlet of the secondary conveyor, to convey the waste toner discharged from the primary conveyor and the secondary conveyor, the relay conveyor includes a hollow, relay conveyor pipe of which an area of an interior of the relay conveyor is greater than an area of an interior of the primary conveyor pipe and the secondary conveyor pipe; and a waste toner container including an inlet in communication with the relay conveyor to receive the waste toner discharged from the relay conveyor, wherein the secondary conveyor outlet is disposed below the primary conveyor outlet and above the inlet of the waste toner container.

13. The waste toner conveying device according to claim 12, wherein the rotatable, secondary conveyor coil is made of a helically coiled metal plate.

14. The waste toner conveying device according to claim 12, further comprising a driver connected to the primary conveyor coil of the primary conveyor and the secondary conveyor coil of the secondary conveyor to drive and rotate the primary conveyor coil and the secondary conveyor coil.

15. The waste toner conveying device according to claim 12, wherein the relay conveyor includes a hollow, relay conveyor pipe extending substantially vertically and joining the primary conveyor pipe of the primary conveyor and the secondary conveyor pipe of the secondary conveyor.

16. The waste toner conveying device according to claim 12, wherein the waste toner container further includes a screw extending in a direction orthogonal to a waste toner conveyance direction of the relay conveyor to convey the waste toner received through the inlet, the screw including:

a shaft; and threads mounted on the shaft, and wherein the screw has a front conveyance span spanning in an axial direction of the screw and a rear conveyance span contiguous to the front conveyance span and spanning in the axial direction of the screw.

17. The waste toner conveying device according to claim 16, wherein the threads have a first diameter corresponding to the front conveyance span and a second diameter corresponding to the rear conveyance span and smaller than the first diameter of the threads.

18. The waste toner conveying device according to claim 16, wherein the threads have a first pitch corresponding to the front conveyance span and a second pitch corresponding to the rear conveyance span and smaller than the first pitch of the threads.

* * * * *